US005464176A

United States Patent [19]

Kruse

[11] Patent Number: 5,464,176

[45] Date of Patent: Nov. 7, 1995

[54] SHUNTING DEVICE

[76] Inventor: Michael J. Kruse, 912 St. Mary's Blvd., Jefferson City, Mo. 65109

[21] Appl. No.: 278,003

[22] Filed: Jul. 20, 1994

[51] Int. Cl.[6] ..... B61L 13/00

[52] U.S. Cl. ..... 246/126; 246/249; 246/252; 191/45 R

[58] Field of Search ..... 246/2 R, 126, 246/127, 128, 130, 167 A, 245, 246, 249, 252, 254, 255; 105/72.2, 215.1, 215.2; 199/45 R

[56] References Cited

U.S. PATENT DOCUMENTS

| | | | |
|---|---|---|---|
| 1,109,899 | 9/1914 | Colas et al. | 191/45 |
| 1,382,121 | 6/1921 | Recktenwald | 246/126 |
| 2,084,257 | 6/1937 | Ledwinka | 191/45 |
| 3,157,375 | 11/1964 | Seese | 246/126 |
| 3,252,248 | 5/1966 | Zalkind | 191/45 |
| 5,029,780 | 7/1991 | Peel | 246/127 |
| 5,054,722 | 10/1991 | Bartel et al. | 246/126 |
| 5,170,970 | 12/1992 | Ballinger | 246/34 |

FOREIGN PATENT DOCUMENTS

| | | | |
|---|---|---|---|
| 264914 | 10/1932 | Italy | 246/126 |
| 589496 | 3/1959 | Italy | 191/45 |
| 608817 | 9/1960 | Italy | 246/127 |

*Primary Examiner*—Mark T. Le
*Attorney, Agent, or Firm*—Richard J. Grundstrom

[57] ABSTRACT

A shunting device used on railroad maintenance vehicles, such as pickup trucks and other maintenance vehicles, for transmitting electrical signal through railroad tracks for operating signalling devices and notification to the dispatcher. The shunting device consists of a backing plate for attaching the device to the vehicle, an insulator block to electrically isolate the shunting device from the vehicle, a mounting plate for attaching the shunting device to the insulator block and providing height adjustment, a shock tube attached to the mounting plate, a brush support slidable within the shock tube, a biasing mechanism to provide an outward bias to the brush support, a clamping device attached to the brush support, a brush make with a plurality of wire cable secured and held in position within the clamping device, and an electrical connection on the brush support for electrically connecting the shunting device to a signal generator.

15 Claims, 11 Drawing Sheets

SHUNTING DEVICE

BACKGROUND OF THE INVENTION

The present invention relates to a shunting device and more particularly to a device used on railroad maintenance vehicles for making electrical contact with the railroad track to operate signaling devices and communication with a railroad dispatcher.

Shunting devices are used on railroad maintenance vehicles. These vehicles are typically pickup trucks, stake truck and other types of trucks used on the highways. High rail attachment units are usually attached near the front and rear bumper of the vehicle. The high rail attachment unit contains wheel assemblies that align with the railroad track. The high rail attachment unit is lowered as the maintenance vehicle is positioned over the railroad track. The wheel assemblies engage the railroad track to allow the vehicle to be driven on the tracks.

Electrical signals are transmitted through the track to control signaling devices and for communication with the dispatcher. The dispatcher knowing the track is occupied can route trains around the occupied track or take other precautions. Shunting devices provide an electrical contact from a signal generator in the vehicle to the track. Typically, a shunting device will be used at each wheel assembly to provide multiple contact points. Independent signals can be given to each tracks or the track can be shorted as needed.

Electrical signals have to be given on a continuous basis or at predetermined intervals to prevent accidents and operate signaling devices. To ensure that the signal can be given at the correct time, there must be a continuous electrical contact between the signal generator and the track. The shunting devices must also be electrically isolated from each other so independent signals can be given to each track. Railroad tracks may also have irregularities, unevenness, obstacles, rust and other electrical obstructions. The shunting devices must overcome these obstructions to provide electrical contact with the track. Additionally, larger obstructions may damage the shunting device, high wheel attachment unit or the vehicle. Therefore, a safety means must be provided to prevent undue damage. Since these devices are in constant contact with the railroad track, as the vehicle is driven up and down the railroad track, the shunting devices are being continuously worn down. A means of adjusting for continuous wear must be provided to ensure the continuous contact with the track.

Accordingly, it is an object of the present invention to provide a shunting device that is easily attached to a high wheel attachment unit to make a continuous electrical contact with a railroad track.

Another object of the present invention is to provide an improved shunting device constructed to provide a means of adjusting for continuous wear and for rust and other obstructions on the railroad track while maintaining a continuous electrical contact with the track.

A further object of the present invention is to provide a shunting device adapted for easy adjustment once mounted or attached to a high wheel attachment unit to increase the assurance of continuous electrical contact with a rail.

Still another object of the present invention is to provide a shunting device that is electrically isolated from the vehicle and from each other and to provide a safety break to prevent damage to the shunting device, high wheel attachment unit and the vehicle.

SUMMARY OF THE INVENTION

To accomplish the foregoing and other objects of this invention there is provided a shunting device and more particularly to a shunting device used on railroad maintenance vehicles that attach to a high rail attachment units for relaying electrical signals to tracks for operating railroad signaling devices and signaling the dispatcher.

The shunting device of this invention consists of the following: A backing plate, made of plate steel, for attaching the shunting device to a vehicle. An insulator block made from an electrically insulating material attached to the backing plate. A mounting plate with a plurality of slotted openings secured to the insulator block by a plurality of bolts extending through the slotted openings. The slotted opening provides height adjustment for the shunting device. The mounting plate is electrically insulated from the backing plate by the insulator block. A shock tube consisting of a rectangular tubular member having a first end and a second end. The first end of the shock tube is closed off with an end plate. The second end remains open. One outer surface of the shock tube is attached to the mounting plate. A brush support consisting of a rectangular section and a threaded rod section. The rectangular section has four side surfaces, a first end and a second end. The threaded rod section extends from the first end. A slotted opening is cut through the rectangular section from a first side surface to a third side surface. The brush support, threaded rod section first, is inserted within the open second end of the shock tube. A bias means within the shock tube provides an outward bias on the brush support. A threaded end of the threaded rod section extends through a bore in the end plate of the shock tube. A tension adjustment nut is screwed onto the end of the threaded rod section. The tension adjustment nut tightens against the end plate to provide fine height adjustment and to adjust the outward bias on the brush support. A safety bolt extends through the shock tube through the slotted opening in the bush support. The brush support can slide within the shock tube along the safety bolt the length of the slotted opening. An electrical connection bolt is screwed into a threaded bore contained on the end of the threaded rod section. A first clamping device, consisting of a clamping base and clamping plate, is attached to the end of the brush support. A brush made from a plurality of wire cables is clamped within the first clamping device.

The brush of the shunting device drags along the railroad track to make electrical contact with the track. Electrical signals from a signal generator can then be relayed to the railroad track. The electrical signals, via the railroad tracks, operate signaling devices and communicate with railroad dispatchers. The above mentioned and other objects and features of the present invention will be better understood and appreciated from the following detailed description of the main embodiment thereof, selected for purposes of illustration and shown in the accompanying drawings.

DETAILED DESCRIPTION

Figure 1:
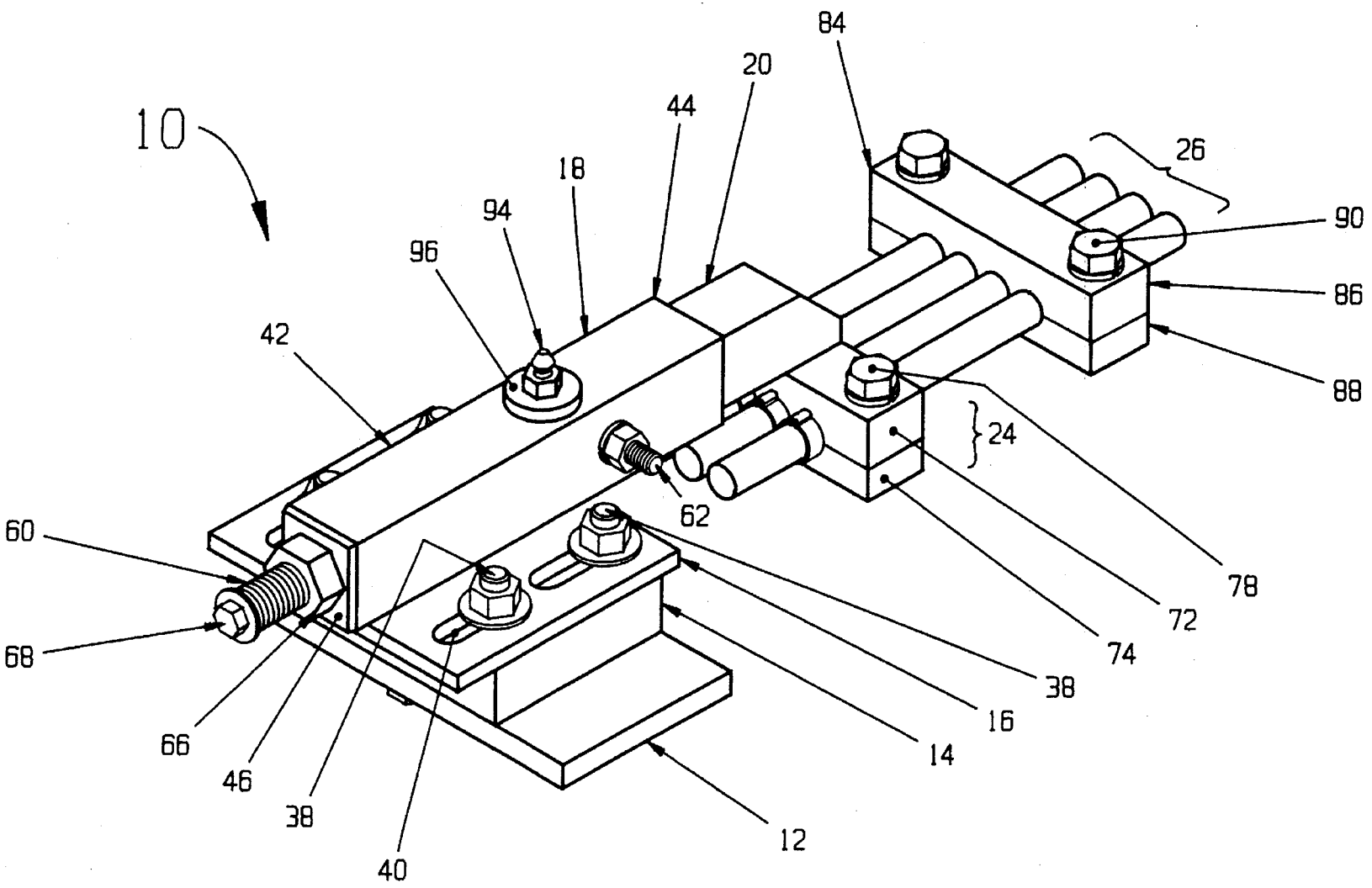
FIG. 1 is an isometric view of the shunting device of this invention.

Referring to the drawings there is shown the preferred embodiment for the shunting device 10 of this invention. The shunting device 10, in a simple listing of the basic components of the preferred embodiment, consists of a backing plate 12, an insulator block 14, a mounting plate 16, a shock tube 18, a brush support 20, a bias means 22, a first clamping means 24 and a brush 26. Other components are included in the detailed description. The basic components listed are the minimum necessary for this device to function properly.

The preferred embodiment and the best mode contemplated of the shunting device of the present invention are herein described. However, it should be understood that the best mode for carrying out the invention hereinafter described is offered by way of illustration and not by the way of limitation. It is intended that the scope of the invention includes all modifications that incorporate its principal design features.

The backing plate 12 is basically a piece of plate steel used for attaching the shunting device 10 to a vehicle. In the preferred embodiment, the backing plate 12 is rectangular steel plate with a set of bores corresponding to a particular bolt pattern in the insulator bock. In the best mode contemplated the backing plate measures approximately ⅜ inches thick, 3 inched wide and 5⅝ inches long. The backing plate 12 is typically attached to a high rail attachment unit by welding, but could be attached by other means.

The high rail attachment unit contains wheel assemblies in the front and back of railroad maintenance vehicles. As the vehicle is positioned over railroad tracks the high rail attachment unit lowers the wheel to engage the railroad track. The shunting devices are attached to the high rail attachment for making electrical contact with the tracks. This is necessary to operate railroad signaling devices and for signaling the dispatcher that the track is occupied. Typically, there will be a shunting device 10 used at each wheel which contact the rails. Therefore, each vehicle typically has four shunting devices 10.

Figure 11:
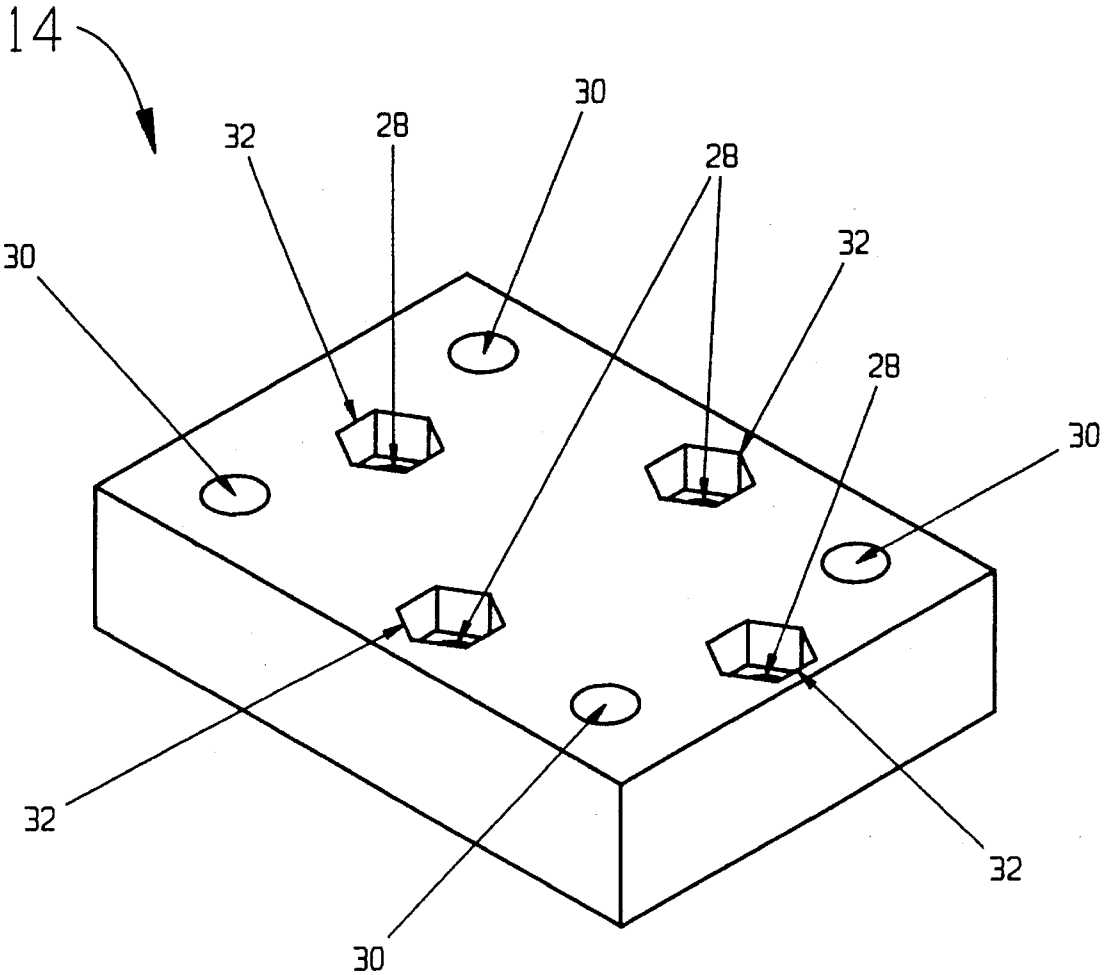
FIG. 11 is an isometric view of the insulator block.
Figure 13:
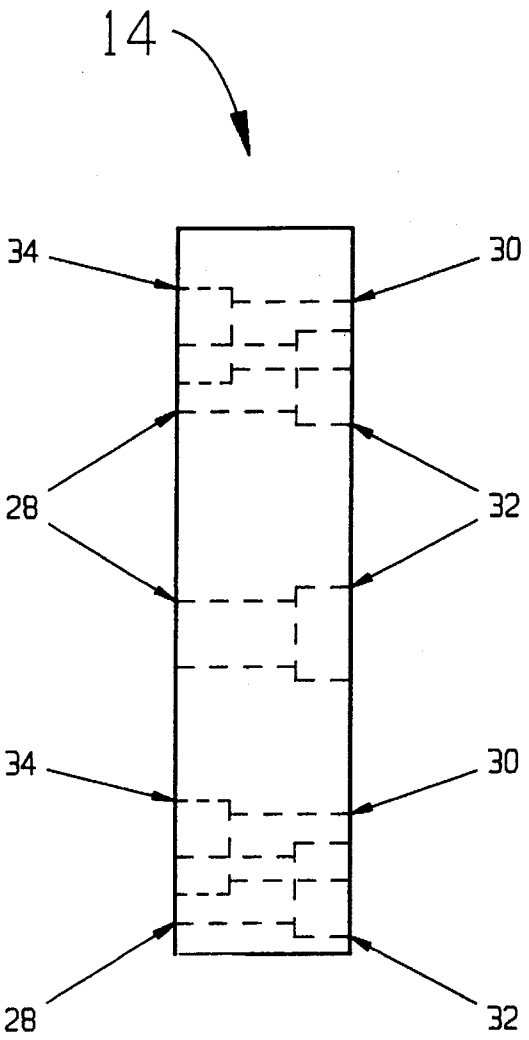
FIG. 13 is a side view of the insulator block.
Figure 12:
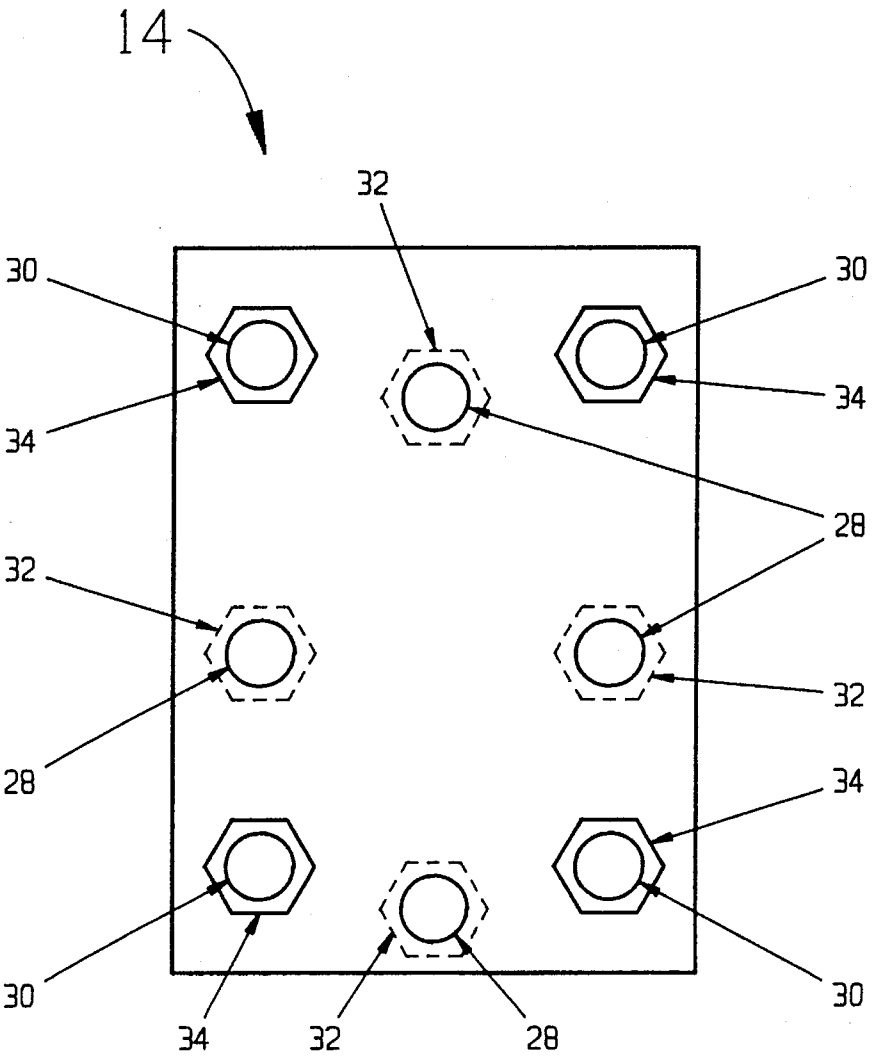
FIG. 12 is a front view of the insulator block.

The insulator block 14, referring to FIGS. 11, 12 and 13, is a rectangular block made of an electrically insulating material. In the preferred embodiment, the insulator block 14 is made from polyethylene, but other insulating materials could also be used. In the best mode contemplated, the insulator block measures approximately 1 inch thick, 3 inches wide and 4¼ inches long. Two sets of bolt patterns, 28 and 30, are bored through the insulator block 14. The first bolt pattern 28 is used to attach the insulator block to the backing plate 12. The first bolt pattern 28 has recesses 32 on one side of the insulator bock 14 to receive and counter sink the heads of bolts 36 used to attach the insulator block 14 to the backing plate 12. Nuts and washers are obviously used on bolts 36 to secure the insulator block 14 to the backing plate 12. Lock nuts or washers may also be used.

The second bolt pattern 30 is used to attach the insulator bock 14 to the mounting plate 16. The second bolt pattern 30 has recesses 34 on the opposite side of the insulator block 14 from the recesses 32. The recesses 34 receive and counter sink heads of bolts 38 used to attach the mounting plate 16 to the insulator bock 14. Again, it is obvious that nuts and washers are used on bolts 38 to secure the mounting plate to the insulator block.

The insulator block serves two purposes. First, it electrically insulates the backing plate from the mounting plate. This electrically isolates the brush 26 from the vehicle so that independent signals can be sent to each track as needed. Secondly, the insulator block serves as a safety break point. During use the insulator block is the weak link and will be the first breaking point in the event that the shunting device encounter or hit an object, obstruction or impairment in the track. This will help to prevent damage to other components, the high rail attachment unit and perhaps the vehicle. It can be easily replaced by bolts 36 and 38.

The mounting plate 16, in the preferred embodiment is made from plate steel. In the best mode contemplated, it measures approximately ¼ inch thick, 4 inches wide and 4½ inches long. The mounting plate 14 has four slotted openings 40 used to provide an adjustable attachment to the insulator block 14. Bolts 38, from the insulator block 14, are inserted through the slotted opening and secured with washers and nuts. The slotted openings 40 provide a sliding height adjustment for the shunting device 10. It provides a means of adjusting the height of the brush 26 in respect to the rail that the brush 26 contacts.

The shock tube 18 is typically made from steel tubing, but could possibly be made from other suitable materials. In the best mode contemplated, the shock tube 18 is a tubular member measuring approximately 1³⁄₁₆ inches wide, 1⅜ inches high and 6⅜ inches long. The shock tube 18 generally has a first end 42, a second end 44 and an end plate 46 closing off the first end 42. The end plate 46 is typically welded in place and contains a center bore 48. The center bore 48 is sized to receive a portion of the brush support 20. One side surfaces near the first end 42 of the tubular member is attached to the mounting plate 16. Typically, the shock tube 18 is attached to the mounting plate 16 by welding.

The brush support 20, in the preferred embodiment, is cut from a solid block of steel. The brush support 20 consists of a rectangular section 50 and a threaded rod section 52. The rectangular section 50 has four side surfaces sized to fit and slide within the shock tube 18. In the best mode contemplated, the rectangular section 50 measures approximately 6⅛ inches long, 1 inch wide and 1⅛ inch thick. The rectangular section 50 has a first end 54 and a second end 56. The threaded rod section 52 extends from the first end 54. The second end 56 may be beveled for safety and aesthetics. The threaded rod section 52, in the best mode contemplated, measures approximately 4⅛ inches long with a diameter of ⅝ inches. The overall length of the brush support is approximately 10¼ inches. Approximately 1⅜ inches of the free end 60 of the threaded rod section 52 is threaded to receive a nut 66. A slotted opening 58 is cut through the rectangular section 50 from one side to an opposite side. The slotted opening 50 is sized to receive a safety bolt 62.

Figure 2:
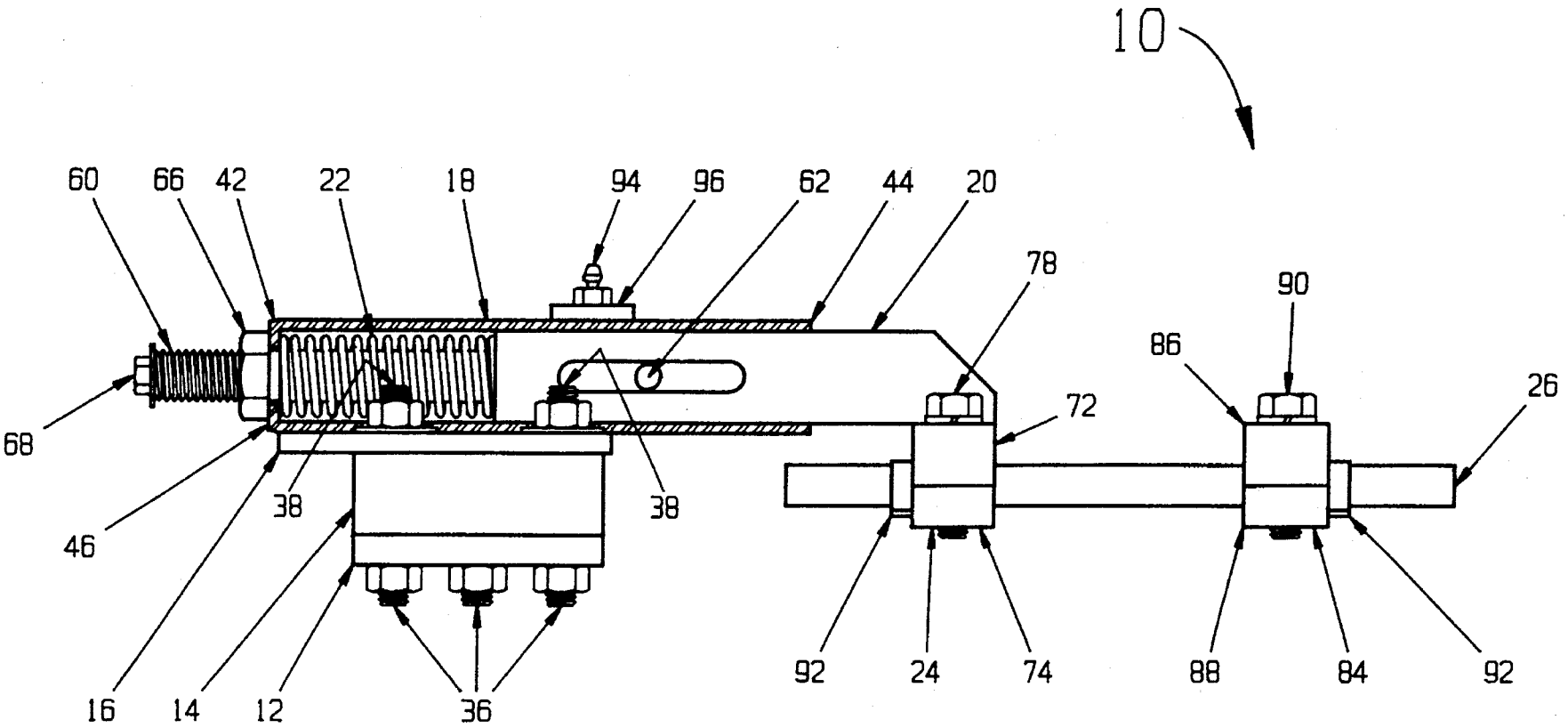
FIG. 2 is a side view of the shunting device with a partial cutaway to show the positioning of the bias means.
Figure 3:
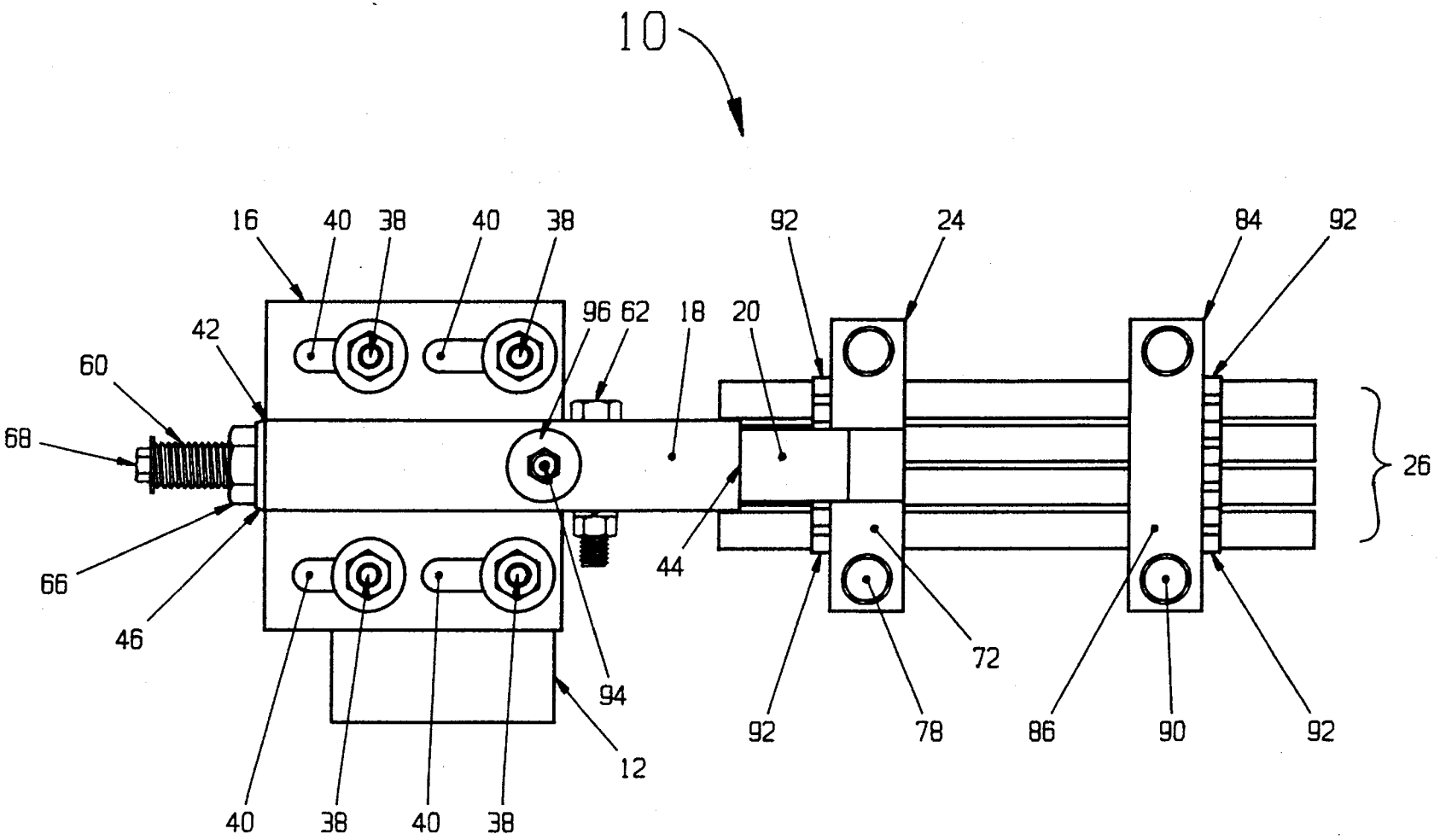
FIG. 3 is a top view of the shunting device.
Figure 4:
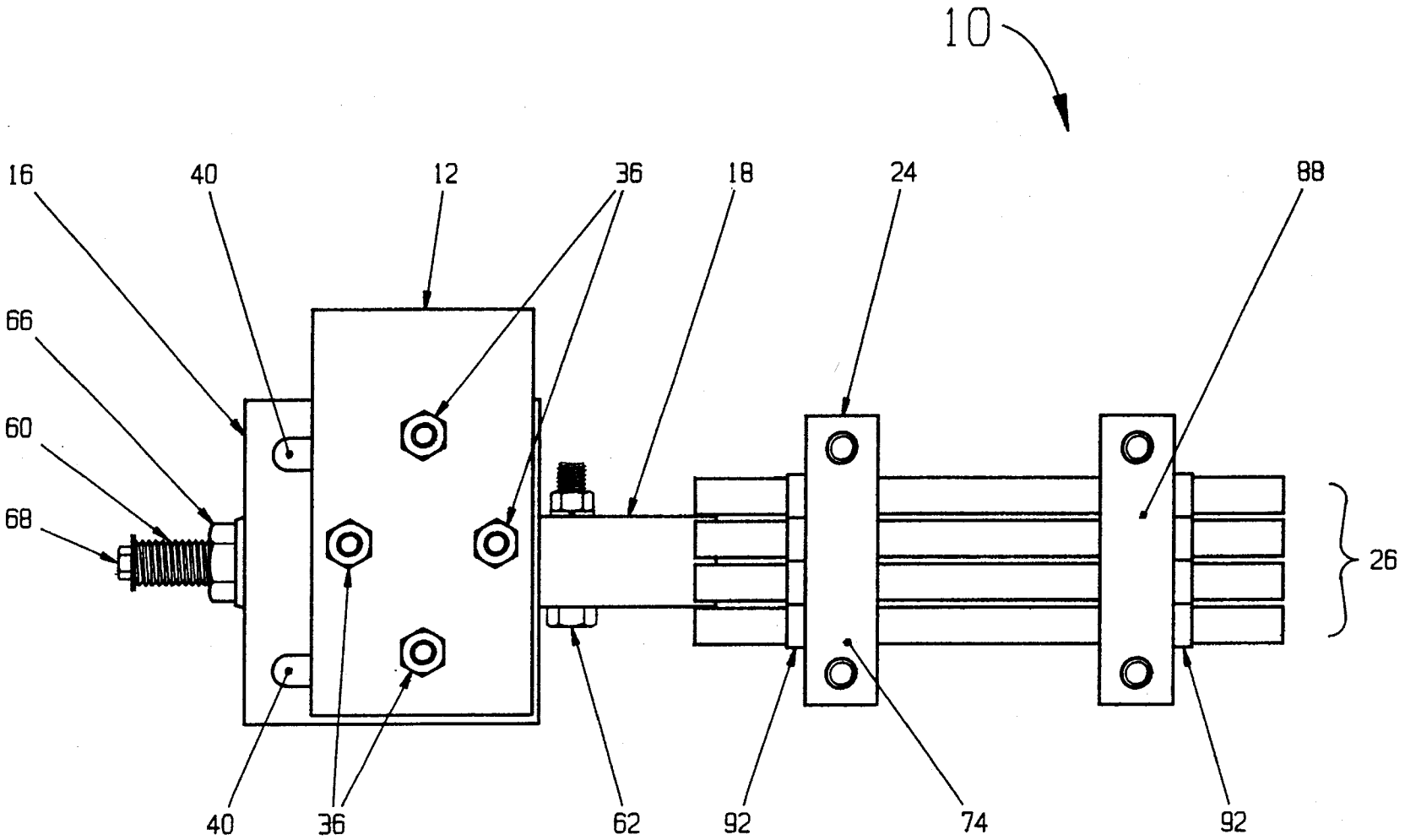
FIG. 4 is a bottom view of the shunting device.
Figure 6:
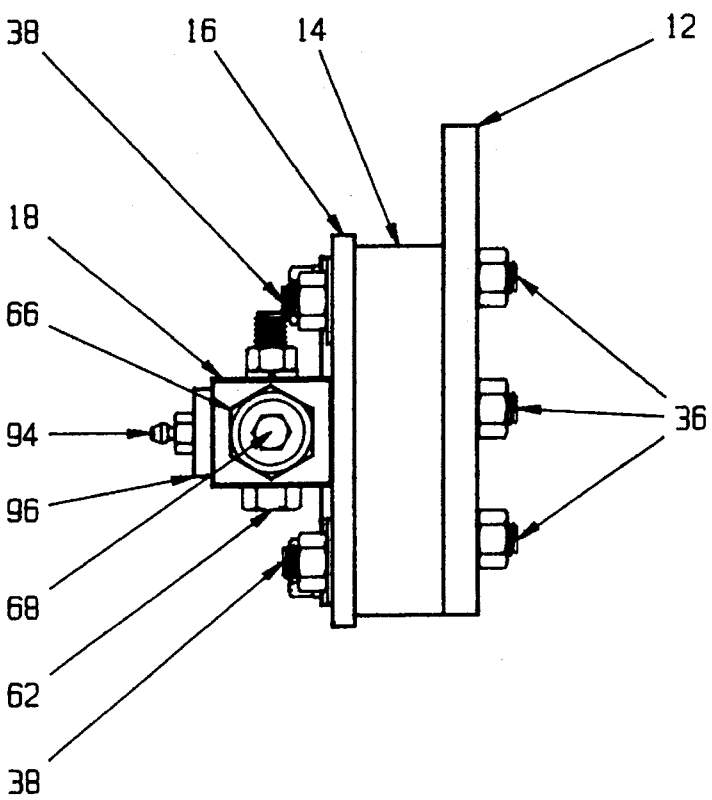
FIG. 6 is a top end view of the shunting device.
Figure 5:
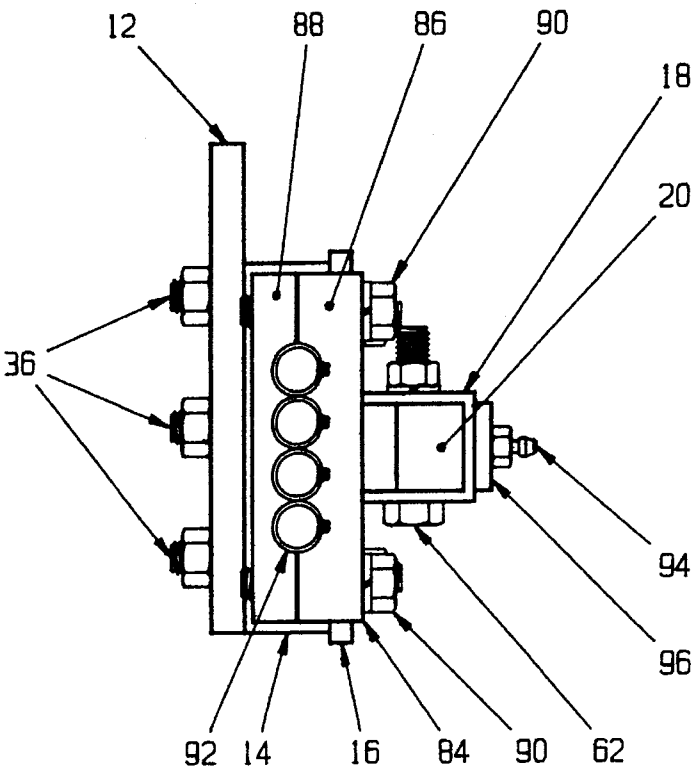
FIG. 5 is a bottom end view of the shunting device.
Figure 7:
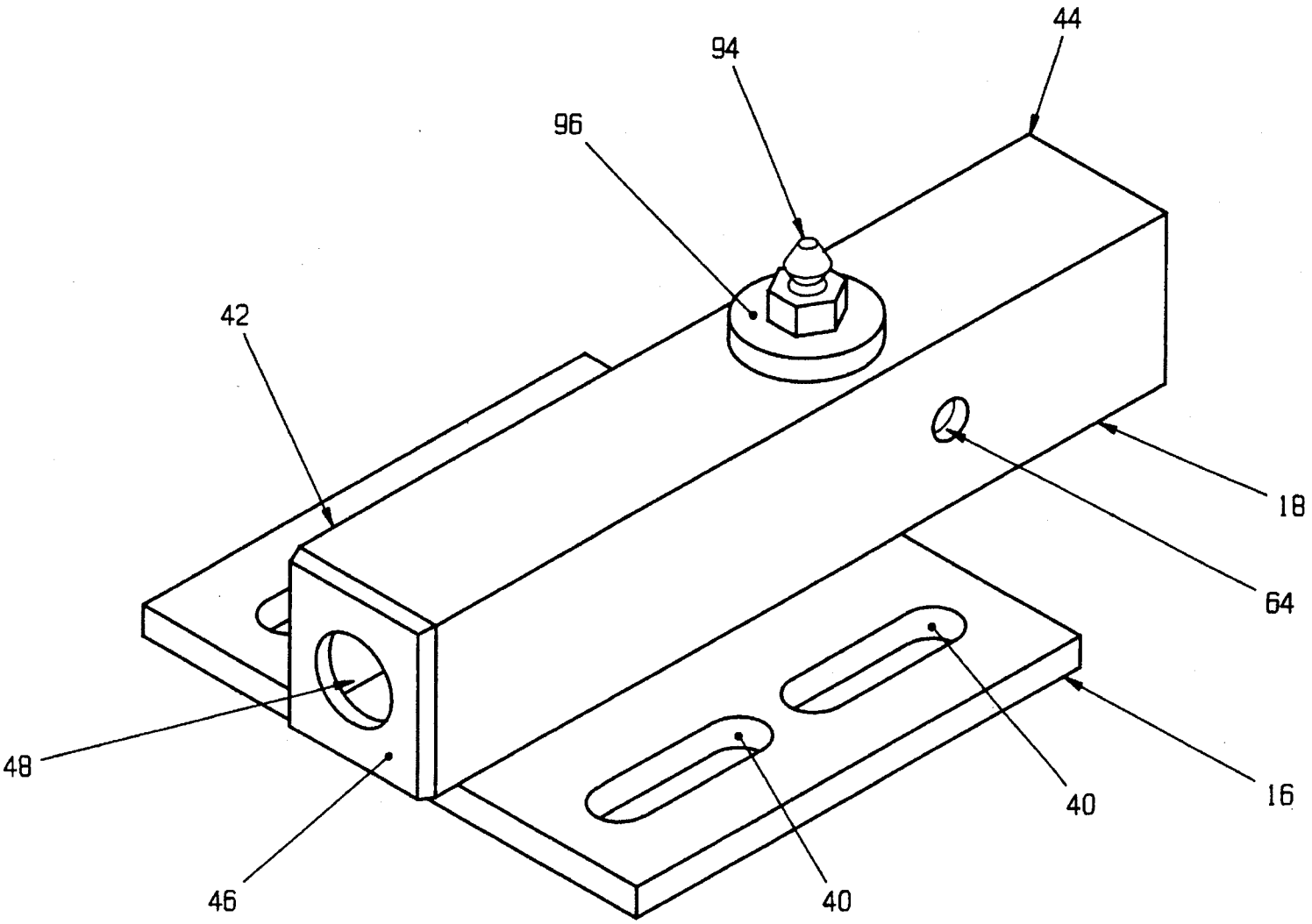
FIG. 7 is an isometric view of the shock tube with the mounting plate attached.
Figure 8:
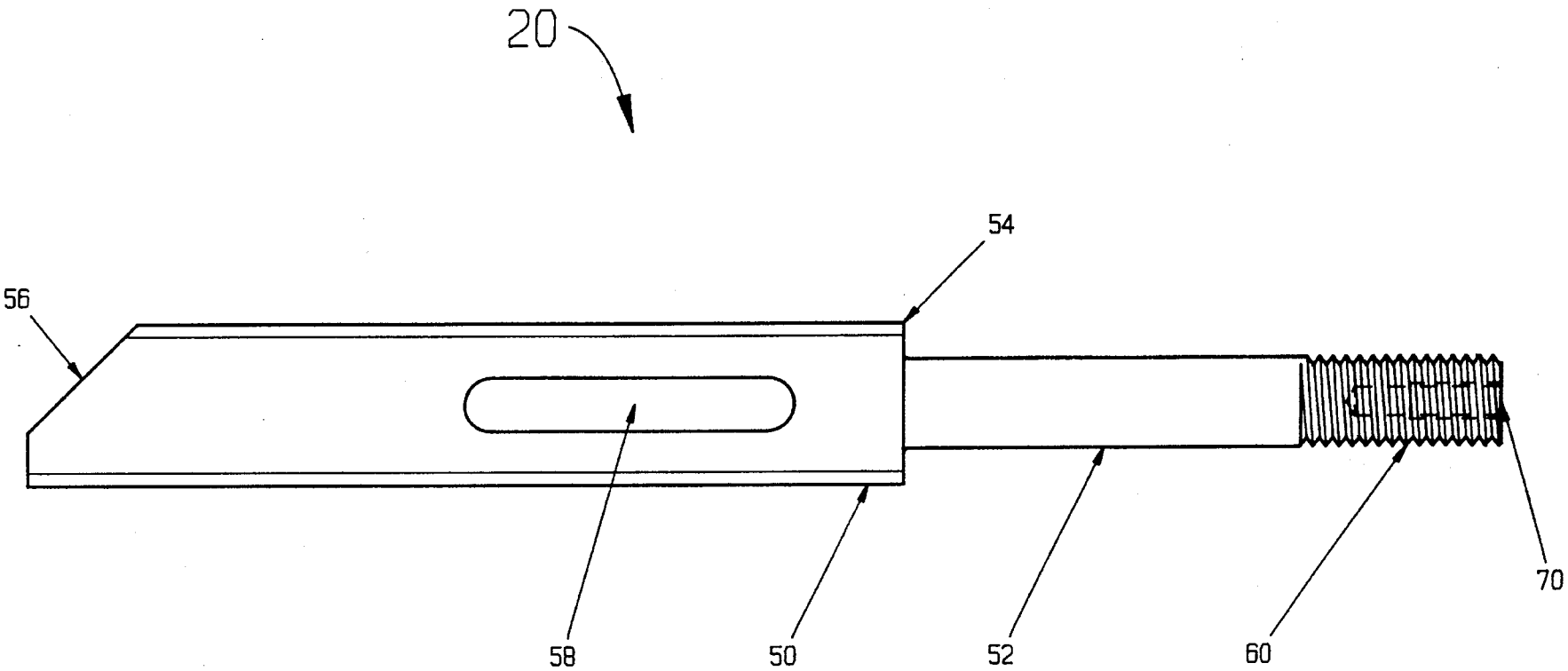
FIG. 8 is a side view of the brush support.

A bias means 22, FIG. 2, provides an outward bias on the brush support 20 to ensure continuous contact of the brush 26 with the railroad track. The bias means 22 in the preferred embodiment is a compression spring, also having reference numeral 22. The compression spring 22 is sized to slip over the threaded rod section 52 of the brush support 20 and to fit within the shock tube 20. The compression spring 22 must have enough bias to force the brush support outward to provide contact with the track yet be able to compress when small obstructions and irregularities are encountered.

The brush support 20, with the compression spring 22 on the threaded rod section 52, is inserted into the second end 44 of the shock tube 18 with the threaded end 60 of the brush support inserted through the center bore 48 in end plate 46. The compression spring 22 contacts the inside surface of the end plate 46. The brush support 20 is slidable within the shock tube 18 with the threaded rod section extending through bore 48 in the end plate.

A tension adjustment nut 66 is screwed onto the threaded end 60 on the threaded rod section 52. The tension adjustment nut 66 holds the brush support 20 within the shock tube 18 and tightens against the end plate 46 to provide adjustment to the outward bias on the brush support 20 and to provide height adjustment for the brush 26, in respect to the tracks. A washer is typically installed between the tension adjustment nut 66 and the end plate 46. The tension adjustment nut 66, in the preferred embodiment, is a lock nut.

A safety bolt 62 extends through a bore 64 on a side surface of the shock tube 18, through the slotted opening 40 in the bush support 20 and through an opposite bore, also labeled as 64, on an opposite side of the shock tube 18. A washer and a nut are obviously used to secure and to hold the bolt 62 in position. A lock washer or lock nut could also be used. The safety bolt 62 provides a safety feature to prevent the brush support 20 from falling out of the shock tube 18 should the tension adjustment nut 66 on the threaded end 60 of the brush support 20 fail. The brush support 20 can slide within the shock tube 18, but will be limited by the length of the slotted opening 40.

Figure 9:
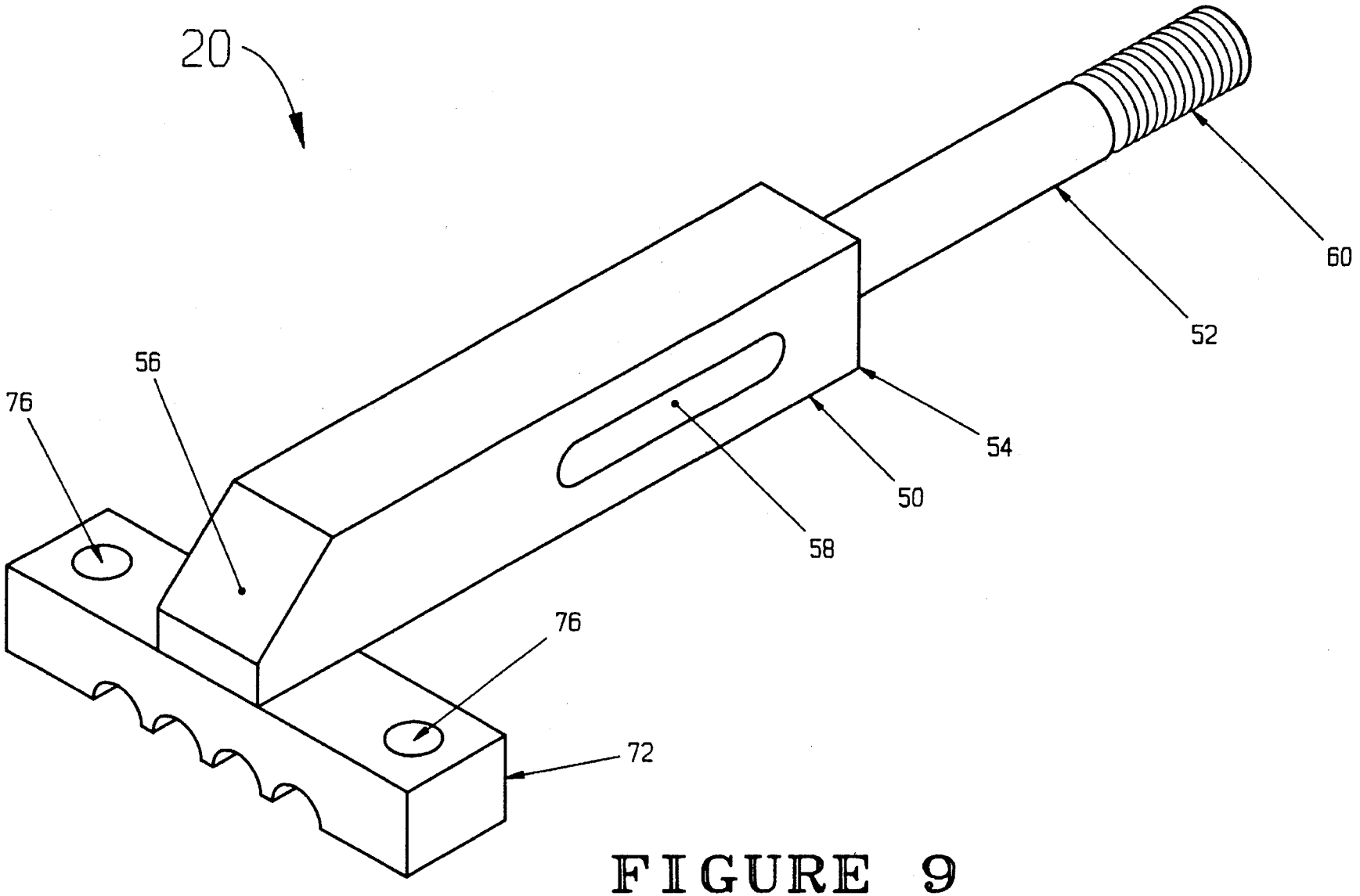
FIG. 9 is an isometric view of the brush support with the clamping base attached.
Figure 10:
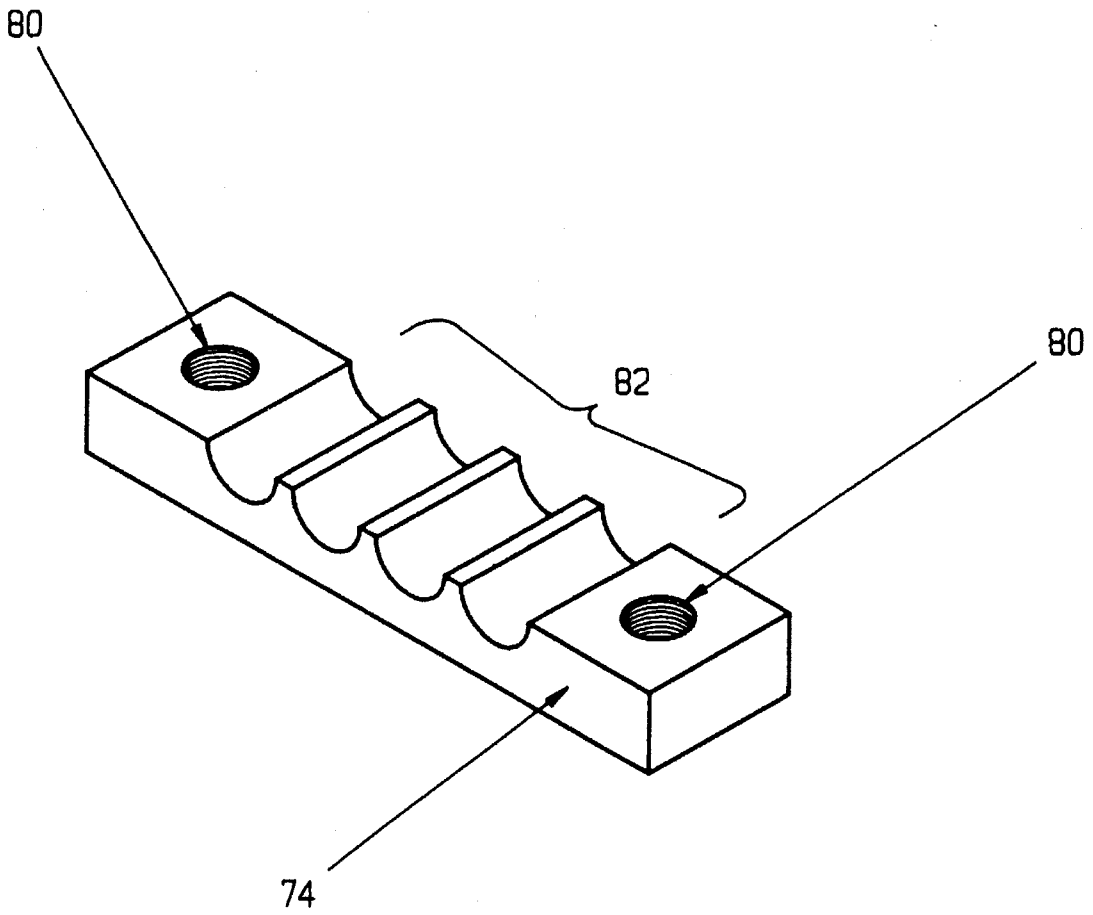
FIG. 10 is an isometric view of the clamping plate.

A first clamping device 24, FIGS. 9 and 10, is used to attach the brush 26 to the brush support 20. The first clamping device 24 consists of a clamping base 72 and a clamping plate 74. The clamping base 72 is permanently attached to the brush support 20. Typically, the clamping base 72 is attached to one of the outer surfaces of the rectangular section 50 of the brush support 20 near end 56 by welding. The clamping base 72, in the preferred embodiment and best mode contemplated, is made from block steel measuring approximately 1 inch wide, 4 inches long and ¾ inch thick. Near the ends of the clamping base 72 are bores 76 for receiving bolts 78. Bolts 78 are used for securing the clamping plate 74 to the clamping base 72.

The clamping plate 74, in the preferred embodiment and best mode contemplated, is also made from block steel, and measures approximately 1 inch wide, 4 inches long, but only ½ inch thick. Near the ends of the clamping plate 74 are threaded bores 80 for receiving bolts 78. The threaded bores 80 are aligned with the bores 76 in the clamping base 72 such that the clamping base and clamping plate can be bolted and secured together.

Between the clamping base 72 and clamping plate 74 is a plurality of brush receiving recesses 82. Each of the recesses 82 receive a wire cable which make up brush 26. The clamping base 72 and the clamping plate 74 each contain one half of each recess 82. The recesses 82 on the clamping base 72 align with the recesses 82 on the clamping plate 74 to make a circular receptacle.

The brush 26 is held and secured in position by the first clamping device 24. The brush 26 consists of a plurality of parallel wire cables clamped within the brush receiving recesses 82 on the first clamping device 24. In the preferred embodiment, the wire brush is made from ½ inch steel wire cable approximately 8 inches long.

A second clamping device 84 may be used to maintain alignment of the ends of the wire cables of brush 26. The second clamping device 84 is used in the preferred embodiment and best mode contemplated. The second clamping device 84 is identical to the first clamping device 24, with the exception it is not connected to the brush support 20. The second clamping device 84 consists of a clamping base 86, a clamping plate 88, bolts 90 and recesses therebetween for receiving and holding brush 26.

A second clamping means 92 may be used to help hold the position of the wire cable in the clamping devices 24 and 84 and to control fraying of the wire cable which make up brush 26. The second clamping means 92 is wrapped around each of the wire cables individually near the ends of the wire cable and near the clamping devices 24 and 84. In the preferred embodiment and best mode contemplate, the second clamping 92 means are crimp type hose clamps. The crimp type hose clamp clamps easily onto the wire cables and does not interfere with the operation of the shunting device.

An electrical connection bolt 68 is provided to make an electrical connection to the brush support 20. The electrical connection bolt 68 is screwed into a threaded bore 70 contained on the threaded end 60 of the threaded rod section 52 of the brush support 20.

A lubrication means is provided to ensure that the brush support 20 slides easily within the shock tube 18. The lubrication means consists of a grease fitting 94 and a fitting base 96. The fitting base 96 is permanently attached to a surface of the shock tube 20, typically by welding. A bore is located through the shock tube 20 under the fitting base 96. The grease fitting 94 is screwed into the fitting base 96. The lubrication means provides a method of injecting grease between the inside surface of the shock tube 18 and outer surface of the brush support 20.

In operation, the backing plate 12 of shunting device 10 is welded to the high wheel attachment unit. The first gross adjustment of the brush 26 is made by adjusting the position of the brush 26 in the first clamping device 24. The mounting plate 16 is then adjusted by sliding the mounting plate 16 up or down via the slotted openings 40 and bolts 38. The tension adjustment nut 66 can then be tightened or loosened to make fine height and tension adjustment. After the tension has been adjusted, the mounting plate 16 may have to be slightly adjusted and the bolts 38 tightened to secure it in position. An electrical wire from a signal generator is attached to the electrical connection bolt 68. The brush 26 drags against the track as the maintenance vehicle drives down the track. The brush 26 make an electrical connection with the track. The electrical signal is transmitted from the signal generator through the shunting device and to the track. The signal generated operate various railroad warning devices and signals the dispatcher that the track is occupied.

Having described the invention in detail, those skilled in the art will appreciate that modifications may be made of the invention without departing from the spirit of the inventive concept herein described.

Therefore, it is not intended that the scope of the invention is limited to the specific and preferred embodiments illustrated and described. Rather, it is intended that the scope of the invention is determined by the appended claims and their equivalents.

What is claimed is:

1. A shunting device comprising:

a backing plate for attachment of the device to a vehicle;

an insulator block attached to said backing plate;

a mounting plate with a plurality of slotted openings secured to said insulator block by a plurality of bolts extending through said slotted openings to provide height adjustment, said mounting plate being electrically insulated from said backing plate by said insulator block;

a shock tube comprising a tubular member having a first end and a second end with an end plate closing off said first end, a side surface near said first end of said tubular member attached to said mounting plate;

a brush support comprising a rectangular section and a threaded rod section, said rectangular section having four side surfaces, a first end and a second end, said threaded rod section extending from said first end, and a slotted opening cut through said rectangular section from a first side surface to a third side surface, said brush support insertable and slidable within said shock tube with said threaded rod section extending through a bore in said end plate of said shock tube;

a safety bolt extending through a first bore on a side surface of said shock tube through said slotted opening in said brush support and through another bore on an opposite side of said shock tube, and a nut screwed onto said safety bolt to hold said bolt in position, said brush support slidable along said safety bolt the length of said slotted opening;

a bias means within said shock tube to provide an outward bias on said brush support;

a tension adjustment nut screwed onto said threaded rod section which extends through said bore in said end plate on said shock tube, said tension adjustment nut tightening against said end plate to provide adjustment to said outward bias on said brush support;

an electrical connection bolt screwed into a threaded bore contained on an end of said threaded rod section of said brush support;

a first clamping device comprising a clamping base attached to a fourth surface near said second end of said brush support and a clamping plate attachable to said clamping base, said clamping base and said clamping plate having a plurality of brush receiving recesses therebetween; and a brush comprising a plurality of wire cables clamped within said brush receiving recesses on said first clamping device.

2. The shunting device as set forth in claim 1 further comprising a second clamping device which comprises a clamping base and a clamping plate, said clamping plate attachable to said clamping base, said second clamping device attached to said wire cables to maintain alignment of ends of said wire cables.

3. The shunting device as set forth in claim 1 further comprising a plurality of second clamping means wrapped around each of said wire cables for maintaining position and integrity of said wire cables by controlling fraying of said wire cable.

4. The shunting device as set forth in claim 1 further comprising a lubrication means consisting of a grease fitting and a fitting base attached to a side surface of said shock tube, said grease fitting attached to said fitting base, said lubrication means to provide a means to lubricate said brush support which is slidable within said shock tube.

5. A shunting device comprising:

a backing plate for attaching the device to a vehicle;

an insulator block attached to said backing plate;

a mounting plate attached to said insulator block, being electrically insulated from said backing plate by said insulator block;

a shock tube attached to said mounting plate;

a brush support, a first end of said brush support inserted into said shock tube, said brush support being slidable within said shock tube;

a bias means contained within said shock tube to provide an outward bias to said brush support;

a clamping device attached a second end of said brush support;

a plurality of wire cable secured and held in position within said clamping device; and an electrical connection on said brush support for electrically connecting said shunting device to a signal generator.

6. The shunting device as set forth in claim 5 in which said backing plate comprises a steel plate weldable to said vehicle and having a bolt pattern thereon.

7. The shunting device as set forth in claim 5 in which said insulator block comprises a block made from an electrically insulating material and having a first and second bolt pattern thereon, said first bolt pattern for attaching said insulator block to said backing plate and said second bolt pattern for attaching said mounting plate to said insulator block.

8. The shunting device as set forth in claim 5 in which said mounting plate comprises a steel plate having a plurality of slotted opening corresponding to a bolt pattern in said insulator block, said slotted opening providing a means of height adjustment of said shunting device.

9. The shunting device as set forth in claim 5 in which said shock tube comprises a rectangular tubing attached to said mounting plate having a first end closed with an end plate and a second end open for receiving said brush support.

10. The shunting device as set forth in claim 5 further comprising a safety bolt, said safety bolt extending through a bore in said shock tube and through a slotted opening cut in said brush support, said safety bolt preventing said brush support from falling out of said shock tube, and said slotted opening providing a limit to movement of said brush support within said shock tube.

11. The shunting device as set forth in claim 5 in which said brush support comprises a rectangular section and a threaded rod section, said threaded rod section extending from a first end of said rectangular section, said threaded rod section being inserted into said shock tube, said bias means within said shock tube fitting over said threaded rod section, an end of said threaded rod section extending through a bore in a closed end of said shock tube and a nut screwed onto a threaded end of said threaded rod section to provide retention of said brush support within said shock tube and to provide tension adjustment of said outward bias and said clamping device being attached to a second end of said rectangular section.

12. The shunting device as set forth in claim 5 further comprising a second clamping device attached to said wire cables for maintaining alignment of said wire cables at a position outward from said first clamping device.

13. The shunting device as set forth in claim 5 further comprising a lubrication means attached to said shock tube to provide lubrication to said brush support slideable within said shock tube, said lubrication means comprising a grease fitting screwed into a fitting base on said shock tube.

14. The shunting device as set forth in claim 5 further comprising a second clamping means, said second clamping means wrapped around each of said wire cable for preventing fraying of said wire cables and to assist in positioning said wire cables within said first clamping device.

15. A shunting device comprising:

a backing plate for attachment of the device to a vehicle;

an insulator block attached to said backing plate;

a mounting plate with a plurality of slotted openings secured to said insulator block by a plurality of bolts extending through said slotted openings to provide height adjustment, said mounting plate being electrically insulated from said backing plate by said insulator block;

a shock tube comprising a tubular member having a first end and a second end with an end plate closing off said first end, a side surface near said first end of said tubular member attached to said mounting plate;

a brush support comprising a rectangular section and a threaded rod section, said rectangular section having four side surfaces, a first end and a second end, said threaded rod section extending from said first end, and a slotted opening cut through said rectangular section from a first side surface to a third side surface, said brush support insertable and slidable within said shock tube with said threaded rod section extending through a bore in said end plate of said shock tube;

a safety bolt extending through a first bore on a side surface of said shock tube through said slotted opening in said brush support and through another bore on an opposite side of said shock tube, and a nut screwed onto said safety bolt to hold said bolt in position, said brush support slidably along said safety bolt the length of said slotted opening;

a bias means within said shock tube to provide an outward bias on said brush support;

a tension adjustment nut screwed onto said threaded rod section which extends through said bore in said end plate on said shock tube, said tension adjustment nut tightening against said end plate to provide adjustment to said outward bias on said brush support;

an electrical connection bolt screwed into a threaded bore contained on an end of said threaded rod section of said brush support;

a first clamping device comprising a clamping base attached to a fourth surface near said second end of said brush support and a clamping plate attachable to said clamping base, said clamping base and said clamping plate having a plurality of brush receiving recesses therebetween;

a brush comprising a plurality of wire cables clamped within said brush receiving recesses on said first clamping device;

a second clamping device comprising a clamping base and a clamping plate, said clamping plate attachable to said clamping base, said second clamping device attached to said wire cables at a position outward from said first clamping device to maintain alignment of ends of said wire cables;

a plurality of second clamping means wrapped around each of said wire cables for maintaining position and integrity of said wire cables by controlling fraying of said wire cable; and a lubrication means consisting of a grease fitting and a fitting base attached to a side surface of said shock tube, said grease fitting attached to said fitting base, said lubrication means to provide a means to lubricate said brush support slidable within said shock tube.

* * * * *